US006310641B1

(12) United States Patent
Mrvos et al.

(10) Patent No.: US 6,310,641 B1
(45) Date of Patent: Oct. 30, 2001

(54) INTEGRATED NOZZLE PLATE FOR AN INKJET PRINT HEAD FORMED USING A PHOTOLITHOGRAPHIC METHOD

(75) Inventors: James Michael Mrvos, Lexington; Carl Edmond Sullivan, Versailles, both of KY (US); Ashok Murthy, Tualatin, OR (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/330,973

(22) Filed: Jun. 11, 1999

(51) Int. Cl.[7] ..... B41J 2/14; B41J 2/05
(52) U.S. Cl. ..... 347/47; 347/63
(58) Field of Search ..... 347/63, 65, 20, 347/64, 67, 47, 45

(56) References Cited

U.S. PATENT DOCUMENTS

| | | | | |
|---|---|---|---|---|
| 4,157,935 | | 6/1979 | Solyst | 156/65 |
| 4,415,403 | | 11/1983 | Bakewell | 156/65 |
| 4,521,787 | | 6/1985 | Yokota et al. | 347/65 |
| 4,558,333 | * | 12/1985 | Sugitani | 347/65 |
| 4,666,823 | | 5/1987 | Yokota et al. | 347/65 |
| 4,701,766 | | 10/1987 | Sugitani et al. | 347/65 |
| 4,863,560 | | 9/1989 | Hawkins | 347/65 |
| 5,030,317 | | 7/1991 | Noguchi | 347/65 |
| 5,124,717 | | 6/1992 | Campanelli et al. | 347/65 |
| 5,189,437 | | 2/1993 | Michaelis et al. | 347/65 |
| 5,208,604 | | 5/1993 | Watanabe et al. | 347/65 |
| 5,211,806 | | 5/1993 | Wong et al. | 347/65 |
| 5,275,695 | | 1/1994 | Chang et al. | 156/661.1 |
| 5,308,442 | | 5/1994 | Taub et al. | 347/65 |
| 5,350,616 | * | 9/1994 | Pan et al. | 347/65 |
| 5,385,635 | | 1/1995 | O'Neill et al. | 347/65 |
| 5,408,739 | | 4/1995 | Altavela et al. | 347/65 |
| 5,458,254 | | 10/1995 | Miyagawa et al. | 347/65 |
| 5,478,606 | | 12/1995 | Ohkuma et al. | 347/65 |
| 5,493,320 | * | 2/1996 | Sandbach, Jr. et al. | 347/65 |
| 5,560,837 | | 10/1996 | Trueba | 347/65 |
| 5,565,113 | | 10/1996 | Hadimioglu et al. | 347/46 |
| 5,635,037 | | 6/1997 | Chu et al. | 204/192.35 |
| 5,686,224 | | 11/1997 | O'Neill | 430/320 |
| 5,697,144 | | 12/1997 | Mitani et al. | 347/65 |
| 5,711,891 | | 1/1998 | Pearce | 216/51 |
| 5,716,533 | | 2/1998 | O'Neill et al. | 347/65 |

FOREIGN PATENT DOCUMENTS 0 749 835 A2 6/1996 (EP) .

* cited by examiner

*Primary Examiner*—John Barlow
*Assistant Examiner*—Juanita Stephens
(74) *Attorney, Agent, or Firm*—Staas & Halsey, LLP

(57) ABSTRACT

An integrated nozzle plate having a heater chip and nozzles, firing chambers and channels formed from several layers of resist material affixed to the heater chip. The nozzles, firing chambers and channels are formed in the resist material using a photolithographic method. The photolithographic method involves placing a negative resist layer directly on a silicon wafer heater chip. A protective layer is then placed on top of the negative resist layer to act as a mask. A positive resist layer is then placed on top of the protective layer. A first mask is placed on the positive resist layer. The integrated nozzle plate is then exposed to ultraviolet light and the positive resist layer is developed. The protective layer not covered by the positive resist layer is removed and a second negative resist layer is deposited thereon. A second mask is placed on the second negative resist layer. The first and second negative resist layers are exposed to ultraviolet light and the negative resist layers are developed. The resulting integrated nozzle plate is then mounted to a print head, connected to an ink reservoir and placed in an inkjet printer for use.

11 Claims, 11 Drawing Sheets

INTEGRATED NOZZLE PLATE FOR AN INKJET PRINT HEAD FORMED USING A PHOTOLITHOGRAPHIC METHOD

BACKGROUND OF THE INVENTION

1. Field of the Invention

The present invention relates to an integrated nozzle plate and a method for the forming of the integrated nozzle plate. More particularly, the present invention relates to an integrated nozzle plate formed of multiple resist layers placed directly on a heater chip in a batch manufacturing process using a photolithographic method.

2. Description of the Related Art

Presently, print heads for inkjet printers are manufactured in a process employing several independent steps. This normally entails forming a nozzle plate formed using an excimer laser to ablate nozzles, firing chambers and ink channels in the nozzle plate. The excimer lasers used to create the nozzle plates are extremely large and expensive devices. Once the nozzle plate is formed using the excimer laser, the nozzle plate is aligned and bonded to a heater chip. The heater chip is composed of heating elements that quickly heat ink in individual firing (vaporization) chambers to the point of vaporization. This results in the ejecting of ink through nozzle holes located in the nozzle plate. As heater chips become smaller, more nozzles (typically of smaller dimension) are required to achieve better printing performance and the alignment step between the heater chip and the nozzle plate becomes even more critical.

Current nozzle plate to heater chip alignment requirements specify a tolerance of less than plus or minus 15 microns. Equipment has been developed that mates laser ablated nozzle nozzles plates with heater chips within the tolerances required. This equipment can operate at high speeds and is generally very consistent and accurate. However, the cost of such equipment is extremely high. Further, even though extremely accurate and consistent, the equipment is not perfect and some misalignment does occur. Misalignment of the nozzle plate creates a print head that either has extremely poor print quality or fails to function entirely and these print heads must be rejected. Therefore, the cost of manufacturing a high quality print head using a separate laser ablated nozzle plate and heater chip is very high. This is due to the high cost of the equipment used to ablate the nozzle plates and mate them within the extremely high tolerances to the heater chips. Further, the cost of rejects also adds to the cost of manufacturing.

In addition to the foregoing method of manufacturing a print head, the following methods of manufacturing inkjet print heads are disclosed in the prior art discussed below.

U.S. Pat. No. 5,686,224 to O'Neill discloses the creation of ink channel structures in photoresist material for a side shooter print head. A separate glass plate is then used to close off the open tops of these structures. This patent also describes the use of a variable grade (gray scale mask) to limit the amount of UV light transmitted to certain areas of a photoresist material. To create this structure, O'Neill requires multiple layers of resist to be spun one on top of the other. This process is difficult to use in a manufacturing environment and crisp defined structures are not possible using a variable grade mask. Instead the structures created by O'Neill using UV light exposure through a variable grade mask would tend to be somewhat ragged. In a printing system that demands accuracy in the features used to eject ink jet droplets, this approach would not generate the desired accuracy.

U.S. Pat. No. 5,697,144 to Mitani et al. discloses a method for producing a print head for a printer using thin film processes only. A 1,600 dpi (dot per inch) print head with nozzles arranged two dimensionally on a substrate is possible using this method. Ink channels and nozzle holes are formed using silicon anisotropic etching from both sides of the silicon wafer substrate. After connecting the nozzle plate to the silicon wafer substrate, nozzles are formed in the nozzle plate using photo-etching techniques.

European Patent Application EP 0 749-835 A2 to Inada et al. discloses a method of manufacturing an inkjet print head using photolithographic techniques. The process involves first placing a positive resist layer on a substrate. Photolithographic techniques are then used to form the structures of nozzles, chambers and channels.

However, none of the foregoing prior art references is able to create a print head nozzle plate using photolithographic methods directly on a heater chip to produce complex and highly precise structures in a cost-effective manner.

Thus, a need exists for a method of forming nozzle plates directly on heater chips through a simple and low cost manufacturing method. Further, this manufacturing method must be able to produce a consistent product with very high tolerances.

SUMMARY OF THE INVENTION

An object of the present invention is to create an integrated nozzle using a photolithographic method from resist material. The advantage of this integrated nozzle plate over other nozzle plates is the ability to achieve precise structures with highly defined walls and edges without the need of laser ablating equipment and alignment equipment.

Objects and advantages of the present invention are achieved with the embodiments by an integrated nozzle plate for an inkjet print head. The integrated nozzle plate includes a heater chip having several heating elements. Several photoimageable layers are deposited on the heater chip. A protective layer is positioned between the resist layers. Several firing chambers, nozzles and channels are formed in the photoimageable layers and the protective layer of the integrated nozzle plate.

In accordance with embodiments of the present invention, the photoimageable layers are made of a resist material. Also, the resist layers have a first negative resist layer directly deposited on the heater chip and a second negative resist layer deposited on the first negative resist layer. Further, the protective layer is positioned between the first negative resist layer and the second negative resist layer.

In accordance with embodiments of the present invention, the protective layer is formed of a material that blocks, absorbs or reflects ultraviolet light. Also, the firing chamber is formed in the first negative resist layer and located adjacent to the plurality of heating elements in the heater chip. Further, several nozzles are formed in the second negative resist layer and are connected through the protective layer to the firing chambers. The protective layer also forms a barrier between the second negative resist layer and the firing chambers and the channels. Finally, the integrated nozzle plate is mounted to the print head and attached to an ink reservoir in an inkjet printer.

Further objects and advantages of the present invention are achieved in accordance with embodiments by an integrated nozzle plate for an inkjet print head of an inkjet printer. This integrated nozzle plate includes a heater chip having several heating elements embedded therein. Several firing chambers are formed in the first negative resist layer and positioned adjacent to the heating elements. Several channels are formed in the first negative resist layer and connected to the firing chambers. A protective layer covers the firing chambers and the channels. A second negative resist layer is formed on the first negative resist layer and the protective layer. Several nozzles are formed in the second negative resist layer and the protective layer and connected to the firing chambers.

In accordance with embodiments of the present invention, the first negative resist layer and the second negative resist layer are made of a photoimageable material. Also, the protective layer is made of a material that blocks, absorbs or reflects ultraviolet light. Further, the integrated nozzle plate is mounted on a print head, connected to an ink reservoir and installed in the inkjet printer.

Further objects and advantages of the present invention are achieved in accordance with embodiments by a method of forming an integrated nozzle plate for an inkjet print head. This method entails placing a first negative resist layer on a heater chip having embedded therein several heating elements. A protective layer is placed over the first negative resist layer. A second negative resist layer is placed on the protective layer and the first negative resist layer. Several nozzles, firing chamber, and channels are formed in the first negative resist layer, second negative resist layer, and the protective layer that are interconnected.

In accordance with embodiments of the present invention, the first negative resist layer and the second negative resist layer are made of a photoimageable material. Also, the protective layer is made of a material that blocks, absorbs or reflects ultraviolet light.

Further objects and advantages of the present invention are achieved in accordance with embodiments by a method of manufacturing an integrated nozzle plate for a print head in an inkjet printer. This method places a first negative resist layer on a heater chip. It then places a protective layer on top of the first negative resist layer to act as a mask. Further, it then places a positive resist layer on top of the protective layer. A first mask is placed on the positive resist layer. The integrated nozzle plate is exposed to ultraviolet light through the first mask. The positive resist layer is then developed. The positive resist layer exposed to the ultraviolet light is dissolved as a result of developing. The protective layer not covered by the positive resist layer left after the dissolving of the positive resist layer is removed. The remaining positive resist layer is then removed. A second negative resist layer is deposited on the protective layer and the negative resist layer. A second mask is placed on the second negative resist layer. The negative resist layer is exposed to UV light and developed. The first negative resist layer and the second negative resist layer not exposed to the UV light are removed as a result of developing. Thus, several firing chambers and connected channels are formed in the first resist layer. Several nozzles are formed in the second negative resist layer and are connected to the firing chambers.

In accordance with embodiments of the present invention, the first negative resist layer and the second negative resist layer are made of a photoimageable material. The protective layer is made of a material that blocks, absorbs or reflects ultraviolet light.

In accordance with embodiments of the present invention, the method then mounts the integrated nozzle plate on the print head. It also connects the print head to an ink reservoir and installs the print head in the inkjet printer.

BRIEF DESCRIPTION OF THE DRAWINGS

These and other objects and advantages of the invention will become apparent and more readily appreciated for the following description of the preferred embodiments, taken in conjunction with the accompanying drawings.

DESCRIPTION OF THE PREFERRED EMBODIMENTS

Figure 1:
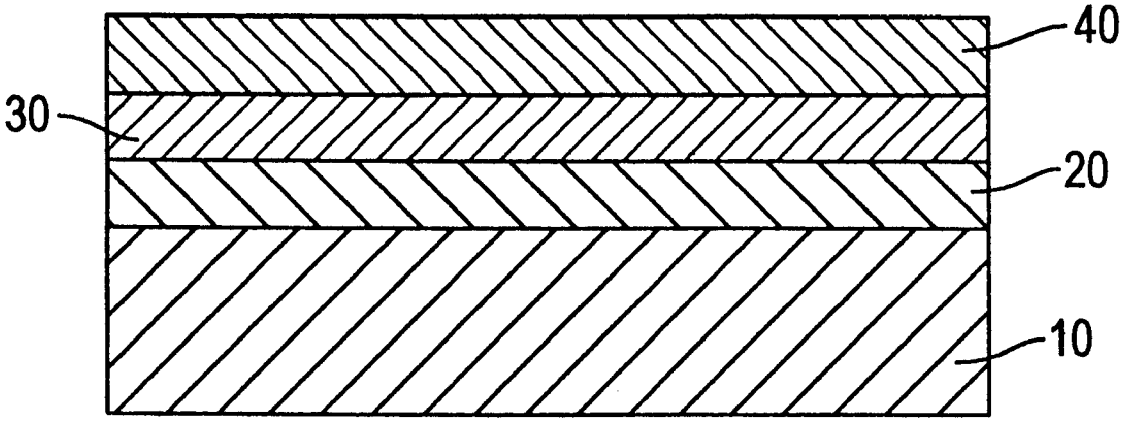
FIG. 1 is a diagram showing an integrated nozzle plate having a heater chip 10 and three layers comprising a first negative resist layer 20, a protective layer 30, and a positive resist layer 40 according to an embodiment of the present invention.

Reference will now be made in detail to the preferred embodiments of the present invention, examples of which are illustrated in the accompanying drawings, wherein like reference numerals refer to like elements throughout.

According to an embodiment of the invention, an integrated nozzle plate is formed out of photoresist material, or photoimageable material, or a combination of both. The integrated nozzle plate comprises two fundamental components. The first component is the heater chip 10 containing a plurality of heating elements 110 embedded therein. Upon the heater chip 10 is placed a plurality of the above mentioned photoresist or photoimageable material in which a plurality of nozzles, firing (vaporization) chambers and channels are formed. A detailed description of the integrated nozzle plate and its method of manufacture are provided below with reference to the figures.

Preferred Embodiment

Figure 9:
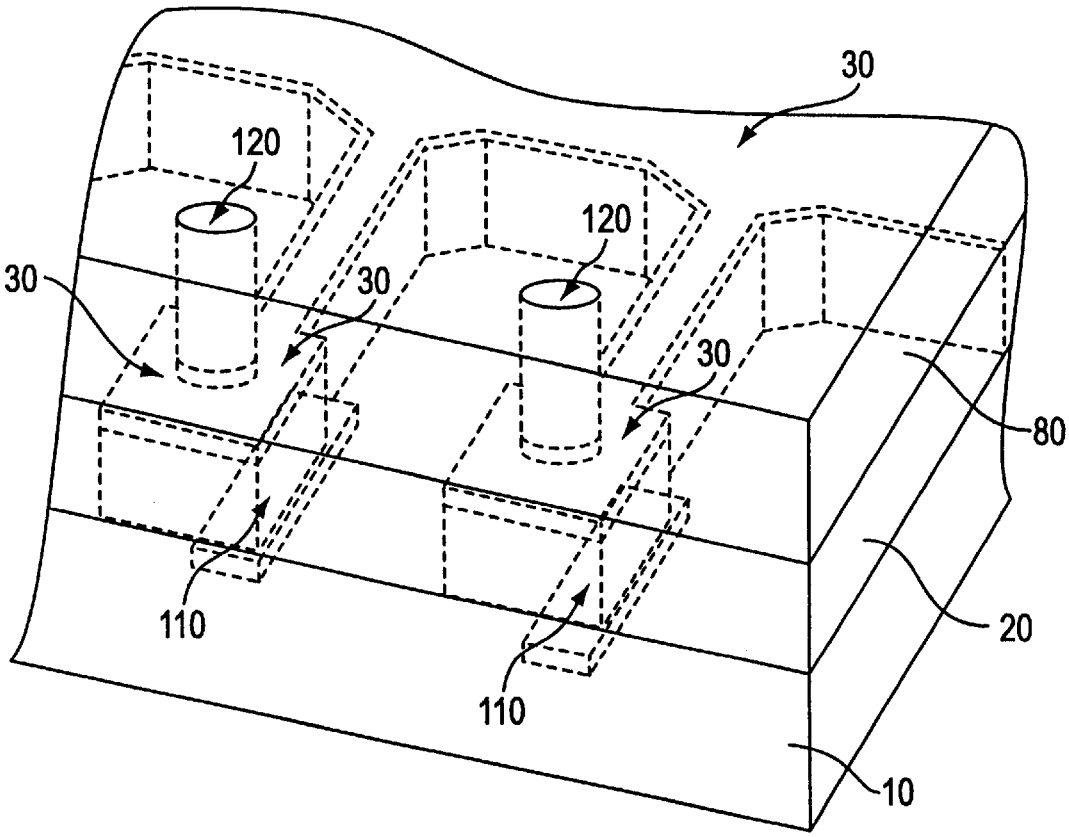
FIG. 9 is a three dimensional top view of the completed integrated nozzle plate shown in FIG 8.
Figure 10A:
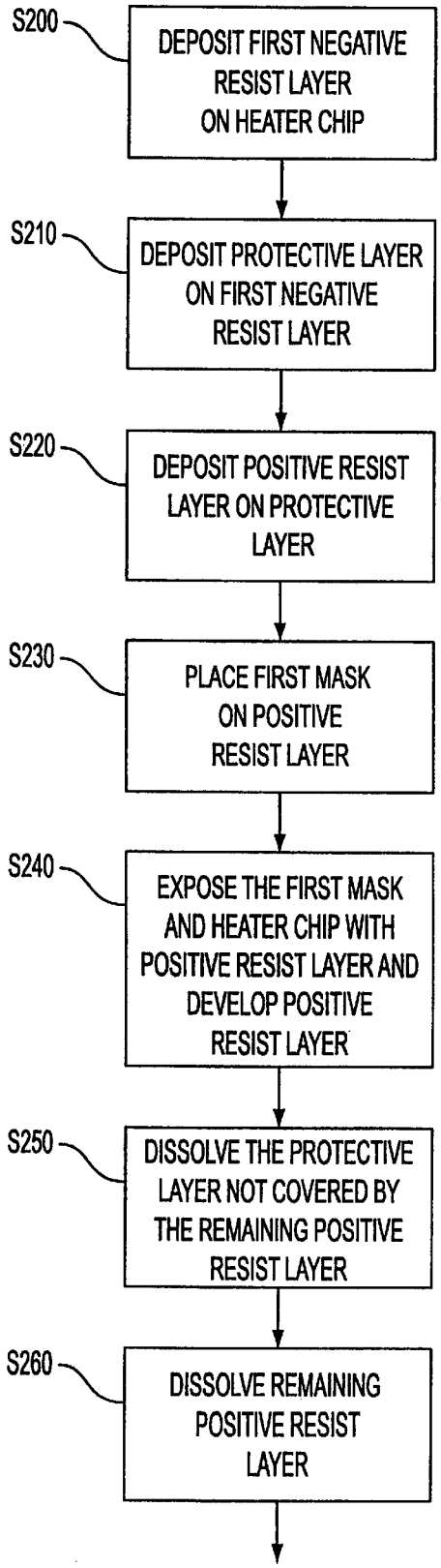
FIG. 10A is a flowchart showing the steps of the method for forming the completed integrated nozzle plate shown in FIG. 8 and FIG. 9.
Figure 10B:
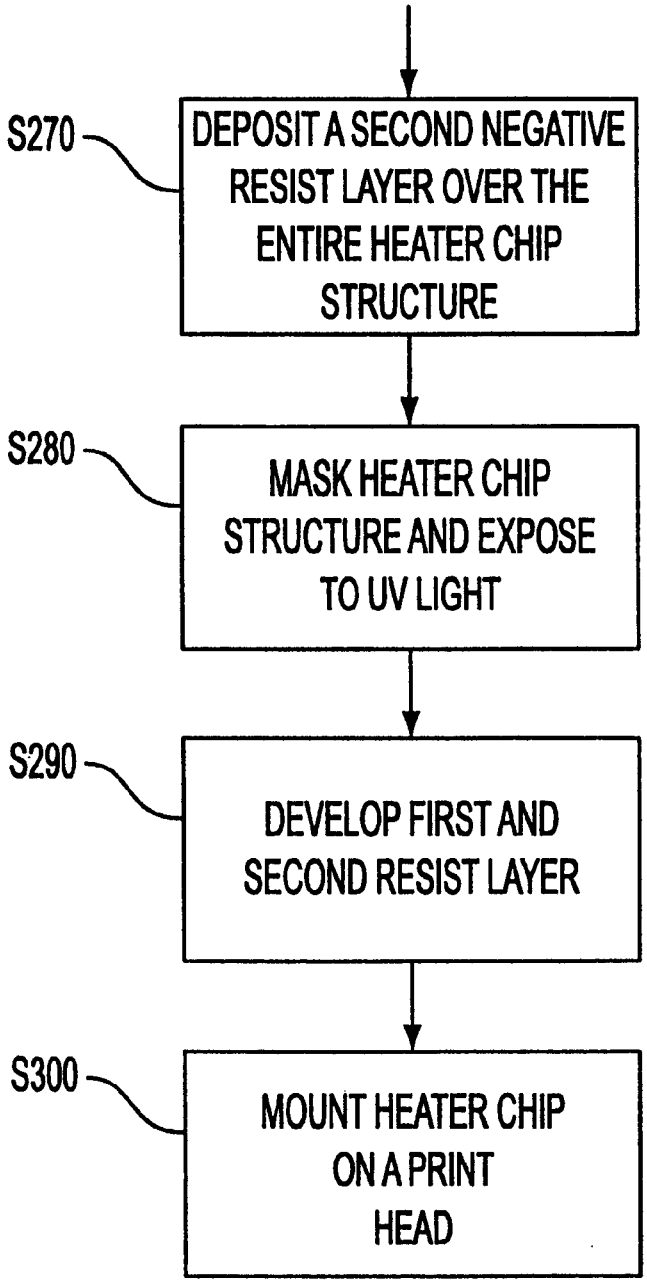
FIG. 10B is the continuation of the flowchart shown in FIG. 10A showing the steps of the method for forming the completed integrated nozzle plate shown in FIG. 8 and FIG. 9.

FIG. 1 is a diagram showing an integrated nozzle plate having a heater chip 10 with heating elements (not shown)

and three layers comprising a first negative resist layer 20, a protective layer 30, and a positive resist layer 40, according to an embodiment of the present invention. Reference will also be made to FIG. 10A and FIG. 10B that are flowcharts describing the steps of the method for manufacturing the completed integrated nozzle plate shown in FIG. 8 and FIG. 9.

As shown in FIG. 1 and step S200 of FIG. 10A, a first negative resist layer 20 made of a dry photoimageable film is laminated or rolled onto a heater chip 10 composed of a silicon wafer containing heating elements (not shown). In this embodiment the chips are center fed, and have already been grit blasted to provide a center feed channel (not shown). However, an edge feed inkjet nozzle design is also possible as would be apparent by one of ordinary skill in the art. The use of a dry photoimageable film allows the coating of the silicon wafer heater chip 10 with the center fed holes present during the coating. Although in this embodiment the dry film will act as negative resist layer 20 in FIG. 1, it is possible to design an integrated nozzle plate that would use a negative or a positive photoimageable film as the initial layer.

Referring still to FIG. 1 and step S210 of FIG. 10A, an ink resistant protective layer 30, made from a metal such as tantalum or other suitable material, is sputtered, spun, evaporated, or laminated onto the uncured (and unexposed) first negative resist layer 20. The material used in the protective layer 30 must fulfill two criteria. First, the protective layer 30 should inhibit the transmission of UV light. Second, the protective layer 30 should be impervious to the inks used in an inkjet printer. With these properties, the protective layer 30 acts essentially as a permanent photomask. Various glasses and plastics will also meet both of the above criteria as would be appreciated by one of ordinary skill in the art and may be used as the protective layer 30.

Referring still to FIG. 1 and step S220 of FIG. 10A, a positive resist layer 40 is now spun, or laminated over the protective layer 30. This positive resist layer 40 will be used to pattern the protective layer 30 in order to create the permanent photomask. Again, as would be appreciated by one of ordinary skill in the art, a negative resist material may be used instead of a positive resist material in the positive resist layer 40.

Figure 2:
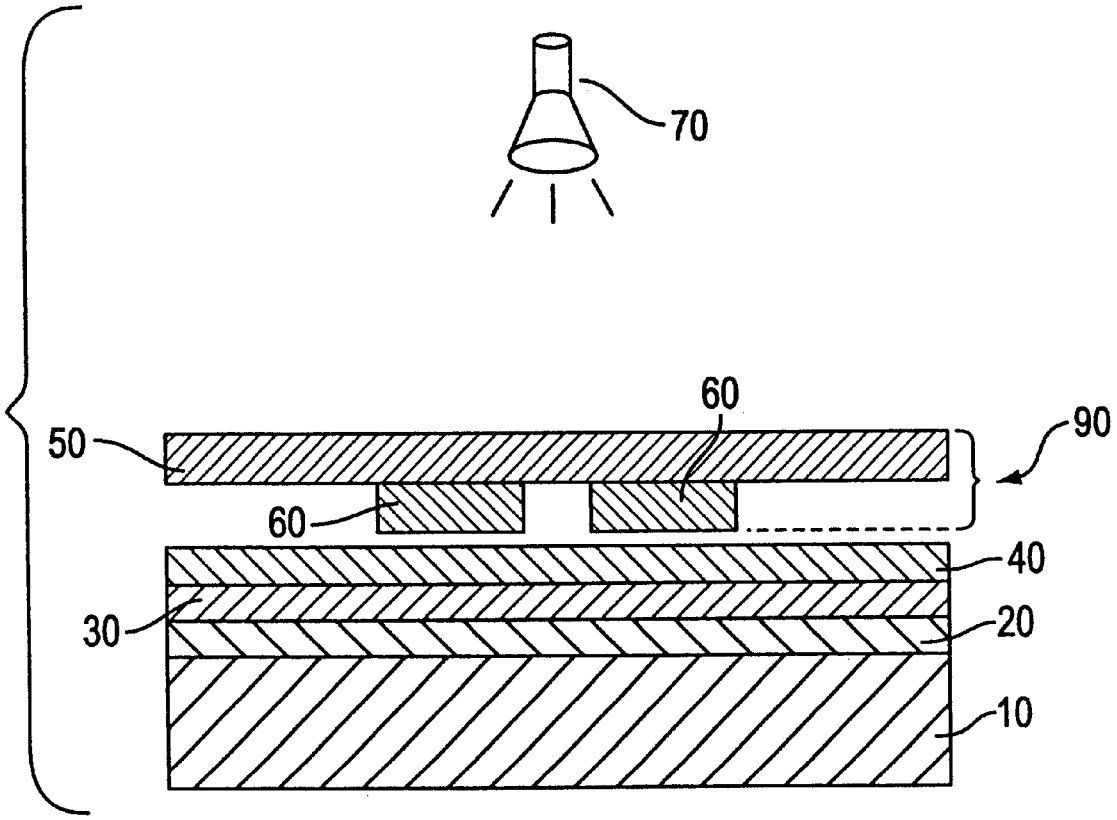
FIG. 2 is a diagram of the integrated nozzle plate of FIG. 1 along with a first mask 90 having a quartz plate 50 and a reflective film 60 being irradiated by a UV light 70 according to an embodiment of the present invention.

Turning now to FIG. 2 and step S230 of FIG. 10A, a first mask 90 comprising a quartz plate 50 and a reflective film 60 is placed on top of the positive resist layer 40. As would be appreciated by one of ordinary skill in the art, quartz plate 50 may be made of any material, including glass, that allows UV (ultraviolet) light to be transmitted through it. Further, the reflective film 60 may be composed of any material, including silver or chrome, that absorbs or reflects UV light.

Figure 3:
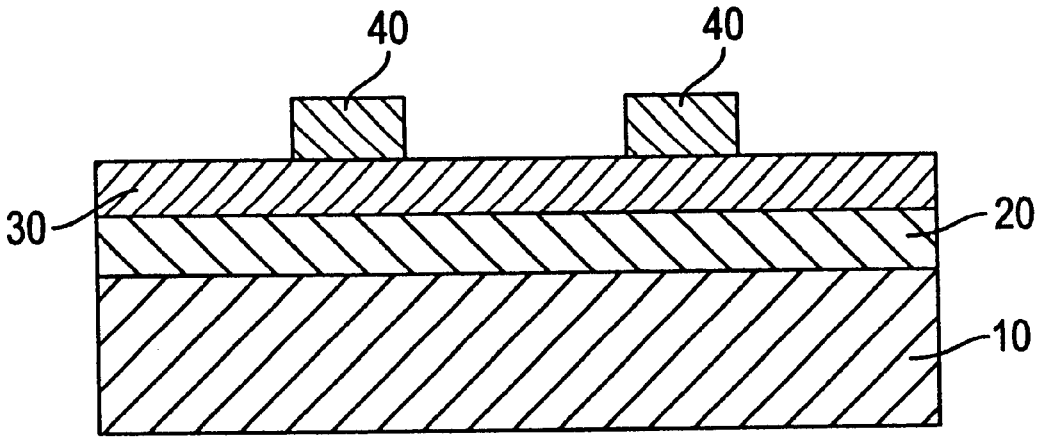
FIG. 3 is a diagram showing the integrated nozzle plate of FIG. 2 after exposure to UV light 70 and development according to an embodiment of the present invention.

Still referring to FIG. 2 and step S240 of FIG. 10A, the positive resist layer 40 is exposed to UV light 70 and developed which produces the results shown in FIG. 3. Note that the protective layer 30 has not been patterned at this point, and therefore will keep UV light from exposing the first negative resist layer 20.

FIG. 3 shows the resulting integrated nozzle plate of FIG. 2 after exposure to UV light 70 and development. Since positive resist material was used in positive resist layer 40, only that positive resist material not exposed to UV light remains after development and the remaining exposed material is dissolved away. Again as would be appreciated by a person of ordinary skill in the art, a negative resist material may be used for positive resist layer 40 with the appropriate changes to mask 90.

Figure 4:
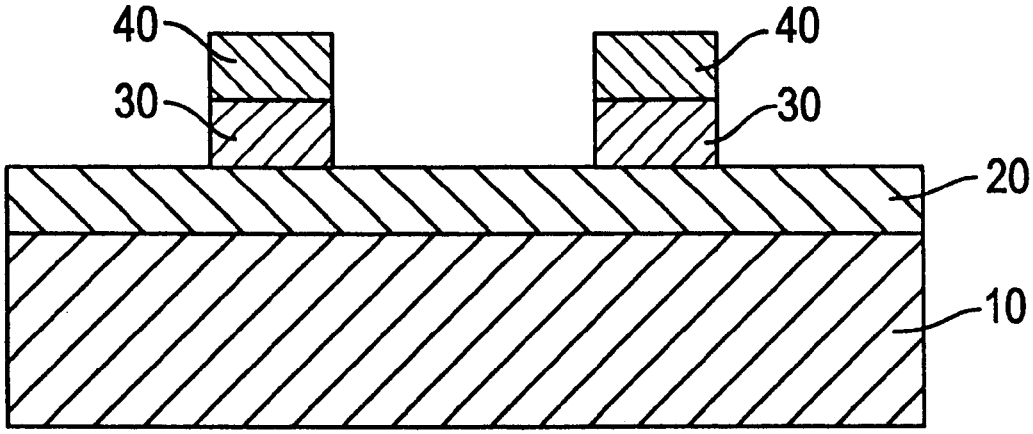
FIG. 4 is a diagram showing the integrated nozzle plate of FIG. 3 after removal of the protective layer 30 not protected by the positive resist layer 40 according to an embodiment of the present invention.

Referring to FIG. 4 and step S250 of FIG. 10A, reactive ion etching (RIE) is used to remove the protective layer 30 not protected with positive resist layer 40. As would be appreciated by one of ordinary skill in the art, this step could also be completed using a wet chemical etching process.

Figure 5:
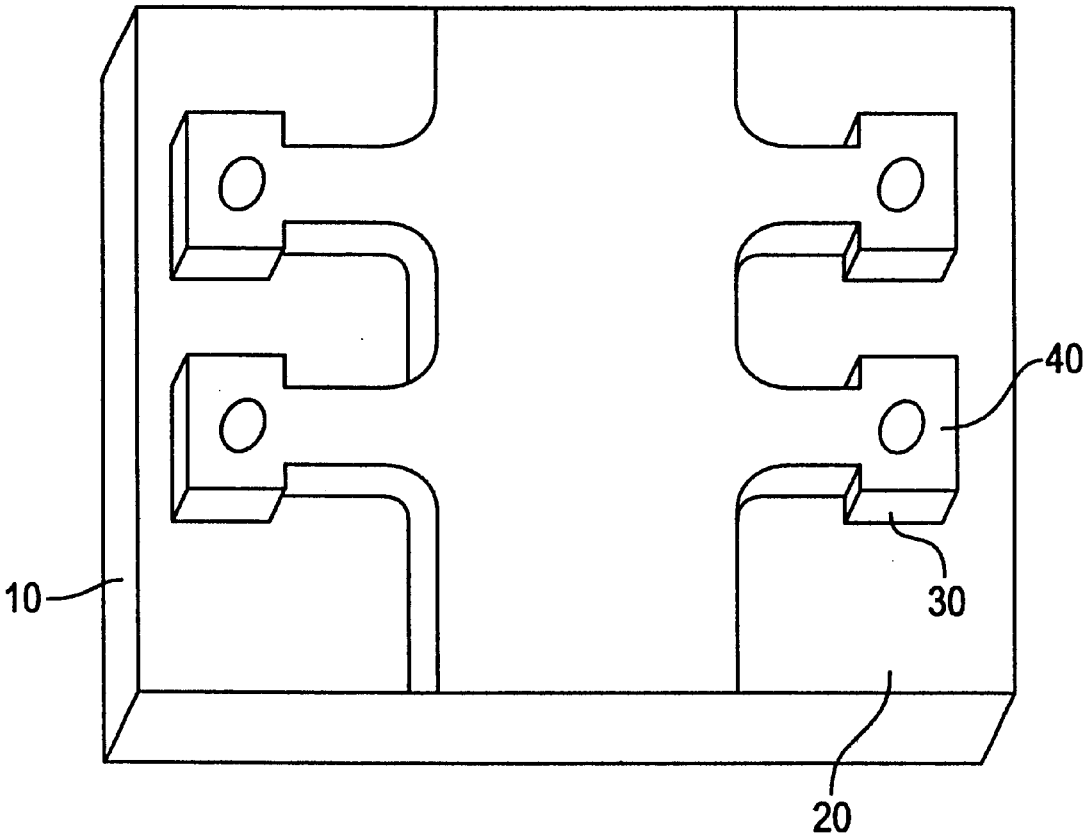
FIG. 5 is a top view of the integrated nozzle plate of FIG. 4 showing the initial formation of channels and nozzles therein according to an embodiment of the present invention.

FIG. 5 is a three-dimensional top view of the integrated nozzle plate FIG. 4 and shows the integrated nozzle plate after completion of step S250 of FIG. 10A. As shown in the FIG. 5, all the initial layers still remain with portions thereof removed including: positive resist layer 40, protective layer 30, and first negative resist layer 20. All these layers are firmly affixed to the heater chip 10.

Figure 6:
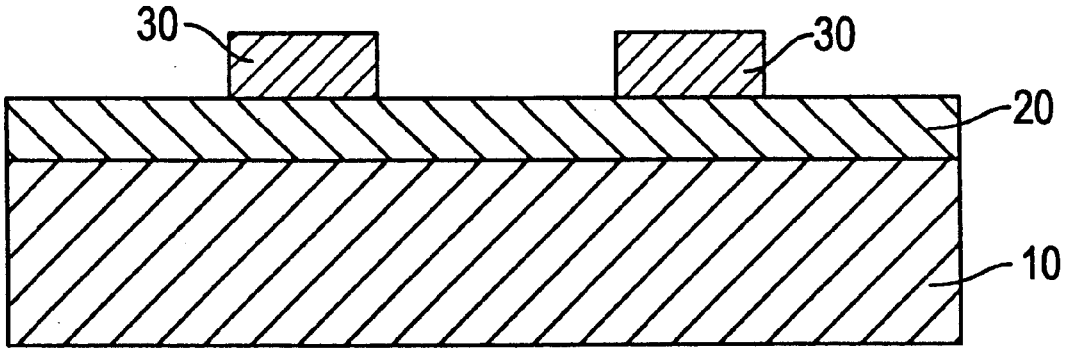
FIG. 6 is a side view of the integrated nozzle plate shown in FIG. 4 and FIG. 5 with the positive resist layer 40 having been removed by chemical processing according to an embodiment of the present invention.

Referring to FIG. 6 and step S260 of FIG. 10A, removal of the remaining positive resist layer 40 with positive resist stripper, or $O_2$ plasma or $O_2$ RIE is then done. This results in only a portion of protective layer 30 remaining over first negative resist layer 20 that adheres to the heater chip 10. It should be noted that slight etching of the first negative resist layer 20 might result in this step. However, as would be appreciated by one of ordinary skill in the art, this is of no concern due to step S270 of FIG. 10B.

Figure 7:
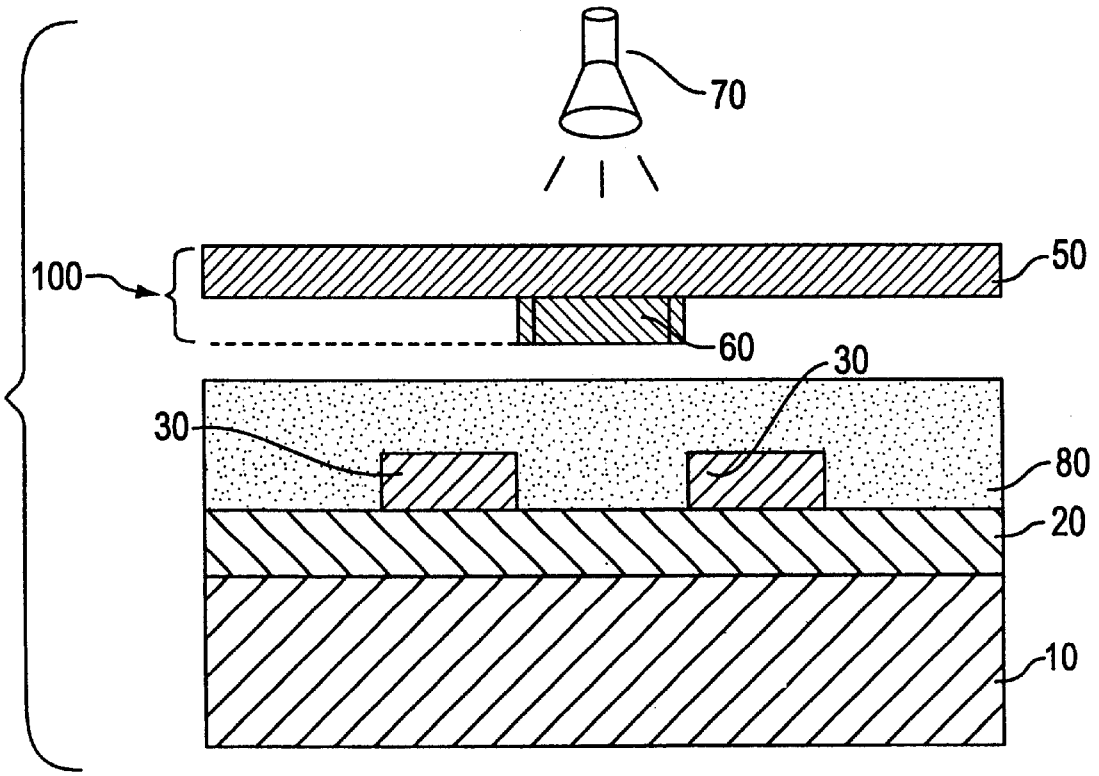
FIG. 7 is a side view of the integrated nozzle plate shown in FIG. 4 with a second negative resist layer 80 added on top of the protective layer 30 and the first negative resist layer 20 along with a second mask 100 being exposed by UV light 70 according to an embodiment of the present invention.

Referring to FIG. 7 and step S270 of FIG. 10B, a second negative resist layer 80 is spun, or laminated on first negative resist layer 20 and protective layer 30. This second resist layer 80 is deposited to the desired height and may be made of Olin SU-8™, or other such product. Step S270 of FIG. 10B will provide the required thickness for the integrated nozzle plate.

Figure 8:
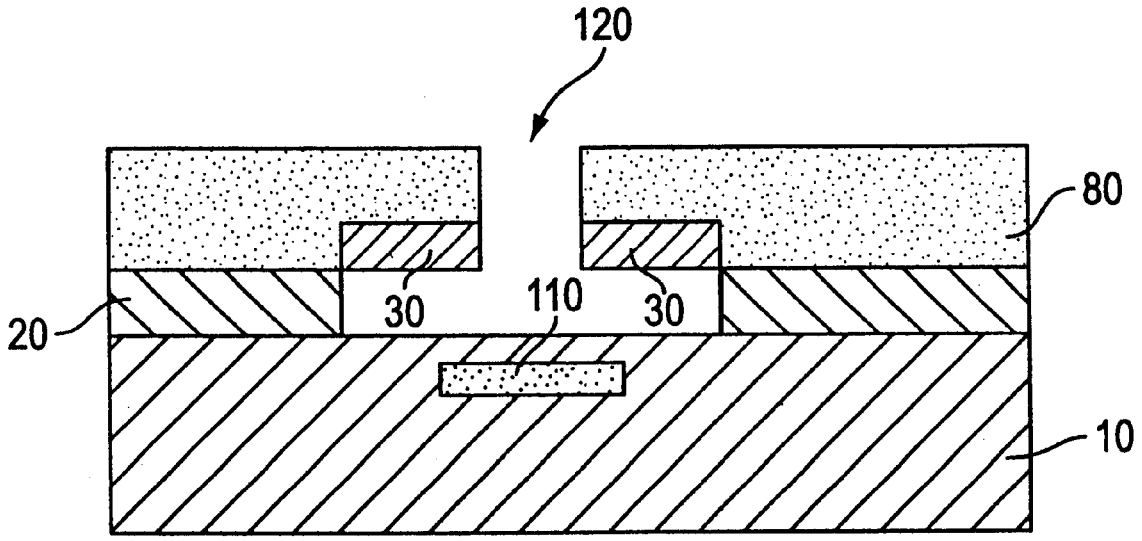
FIG. 8 is a side view of the completed integrated nozzle plate after exposure by UV light 70 shown in FIG. 7 and chemical processing according to an embodiment of the present invention.

Still referring to FIG. 7 and step S280 of FIG. 10B, the second negative resist layer 80 and first negative resist layer 20 (composed of dry negative film) are exposed to UV light 70 using a second mask 100 that will protect the nozzle holes from exposure. This second mask 100 is similar to the first mask 90 with the appropriate changes depending on the desired results and composed of reflective film 60 and quartz plate 50. As would be appreciated by one of ordinary skill in the art, quartz plate 50 may be made of any material, including glass, that allows UV (ultraviolet) light to be transmitted through it. Further, the reflective film 60 may be composed of any material, including silver or chrome, that absorbs or reflects UV light. Note that the negative resist material of first negative resist layer 20 will be protected by the protective layer 30 and will not cross link. Those areas of negative resist layer 20 that have not cross linked will wash away during the development step as shown in FIG. 8, FIG. 9, and step S290 of FIG. 10B. This forms the chambers and channels of the integrated nozzle plate.

Referring to FIG. 7 and step S290 of FIG. 10B, the first negative resist layer and the second negative resist layer 80 is developed after exposure to UV light 70 accomplished in step S280 of FIG. 10B. No further use of the UV light 70 is required in the preferred embodiment of the present invention. As discussed above, those areas of the first negative resist layer 20 and the second resist layer 80 that are not exposed to UV light 70 will also not cross link and will also be washed away during the development step as shown in FIG. 8, FIG. 9, and step S290 of FIG. 10B. In the case of the negative resist layer 20, only that material covered by protective layer 30 and reflective layer 60 of second mask are dissolved away. Regarding negative layer 80, only that portion not exposed to UV light 70 due to the presence of reflective film 60 of second mask 100 are dissolved away in step S290 of FIG. 10B.

The final structure of the integrated nozzle plate will now appear as shown in FIG. 8 and FIG. 9. FIG. 9 is a three-dimensional top view of the completed integrated nozzle plate shown in the side view of FIG. 8.

Referring to step S300 of FIG. 10B, once step S290 of FIG. 10B is completed, the integrated nozzle plate comprising the heater chip 10 and structures shown in FIG. 8 and FIG. 9 is mounted to a print head (not shown). The print head is then attached to an ink reservoir (not shown) and may now be installed in an inkjet printer (not shown).

Alternate Embodiments

As an optional step in step S260 of FIG. 10A, first negative resist layer 20 is exposed to UV light 70. As would be appreciated by one of ordinary skill in the art, the second mask 100 must be used to keep the areas of negative resist layer 20 that will become nozzle holes from being exposed. It should be noted that all areas that are covered by the protective layer 30 (the flow features) will not be exposed.

As a further alternate embodiment of the present invention, steps S210 through S260 of FIG. 10A may be eliminated through the use of a shadow mask (not shown). As would be appreciated by one of ordinary skill in the art, a shadow mask is a mask having orifices contained therein. When placed on a silicon wafer, or when used in the fabrication of an integrated nozzle plate, the protective layer 30 as shown in FIG. 6 may be deposited in a single step. This would occur by manufacturing the shadow mask with the desired configuration of orifices. The first negative resist layer 20 would be spun, or laminated on the heater chip 10. The shadow mask would then be placed on the first negative resist layer 20 and the protective layer 30 would be sputtered, evaporated or otherwise deposited on the first negative resist layer 20. The shadow mask would then be removed leaving the protective layer 30 as shown in FIG. 6.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An integrated nozzle plate for an inkjet print head, comprising:

a heater chip having a plurality of heating elements;

a plurality of photoimageable layers deposited on the heater chip; and a protective layer positioned between the plurality of photoimageable layers, wherein the plurality of photoimageable layers and the protective layer of the integrated nozzle plate embody a plurality of firing chambers, nozzles, and channels.

2. An integrated nozzle plate for an inkjet print head as recited in claim 1, wherein the plurality of photoimageable layers are made of a resist material.

3. An integrated nozzle plate for an inkjet print head as recited in claim 2, wherein the plurality of resist layers comprise:

a first negative resist layer directly deposited on the heater chip; and a second negative resist layer deposited on the first negative resist layer.

4. An integrated nozzle plate for an inkjet print head as recited in claim 3, wherein the protective layer is positioned between the first negative resist layer and the second negative resist layer.

5. An integrated nozzle plate for an inkjet print head as recited in claim 4, wherein the protective layer is formed of a material that blocks, absorbs or reflects ultraviolet light.

6. An integrated nozzle plate for an inkjet print head as recited in claim 4, wherein the plurality of firing chambers are formed in the first negative resist layer and located adjacent to the plurality of heating elements in the heater chip.

7. An integrated nozzle plate for an inkjet print head as recited in claim 6, wherein the plurality of nozzles are formed in the second negative resist layer and are connected through the protective layer to the plurality of firing chambers.

8. An integrated nozzle plate for an inkjet print head as recited in claim 7, wherein the protective layer forms a barrier between the second negative resist layer and the plurality of firing chambers and the plurality of channels.

9. An integrated nozzle plate for an inkjet print head of an inkjet printer, comprising:

a heater chip;

a plurality of heating elements embedded in the heater chip;

a first negative resist layer deposited on the heater chip;

a plurality of firing chambers formed in the first negative resist layer and positioned adjacent to the plurality of heating elements;

a plurality of channels formed in the first negative resist layer and connected to the firing chambers;

a protective layer covering the plurality of firing chambers and the channels;

a second negative resist layer formed on the first negative resist layer and the protective layer; and a plurality of nozzles formed in the second negative resist layer and the protective layer and connected to the plurality of firing chambers.

10. An integrated nozzle plate for an inkjet print head of an inkjet inter as recited in claim 9, wherein the first negative resist layer and the second negative resist layer are made of a photoimageable material.

11. An integrated nozzle plate for an inkjet print head of an inkjet printer as recited in claim 10, wherein the protective layer is made of a material that blocks, absorbs or reflects ultraviolet light.

* * * * *